US008106729B2

(12) United States Patent
Tzuang et al.

(10) Patent No.: US 8,106,729 B2
(45) Date of Patent: Jan. 31, 2012

(54) COMPLEMENTARY-CONDUCTING-STRIP TRANSMISSION LINE STRUCTURE WITH PLURAL STACKED MESH GROUND PLANES

(75) Inventors: Ching-Kuang Tzuang, Taipei (TW); Meng-Ju Chiang, Taipei (TW); Shian-Shun Wu, Taipei (TW)

(73) Assignees: National Taiwan University, Taipei (TW); CMSC, Inc., Hsinchu (TW)

( * ) Notice: Subject to any disclaimer, the term of this patent is extended or adjusted under 35 U.S.C. 154(b) by 179 days.

(21) Appl. No.: 12/508,668

(22) Filed: Jul. 24, 2009

(65) Prior Publication Data

US 2010/0109816 A1 May 6, 2010

(30) Foreign Application Priority Data

Nov. 4, 2008 (TW) ..... 97142454 A

(51) Int. Cl.
*H01P 3/08* (2006.01)

(52) U.S. Cl. ..... 333/238; 333/33

(58) Field of Classification Search ..... 333/238, 333/246, 1, 33

See application file for complete search history.

(56) References Cited

U.S. PATENT DOCUMENTS

| | | | | |
|---|---|---|---|---|
| 6,624,729 | B2 * | 9/2003 | Wright et al. | 333/238 |
| 6,847,274 | B2 * | 1/2005 | Salmela et al. | 333/222 |
| 2007/0241844 | A1 * | 10/2007 | Kim et al. | 333/238 |
| 2008/0061900 | A1 * | 3/2008 | Park et al. | 333/1 |

* cited by examiner

*Primary Examiner* — Benny Lee

(74) *Attorney, Agent, or Firm* — WPAT, PC; Justin King

(57) ABSTRACT

This invention discloses a complementary-conducting-strip transmission line (CCS TL) structure. The CCS TL structure includes a substrate, at least one first mesh ground plane, m second mesh ground planes having m first inter-media-dielectric (IMD) layers interlaced with and stacked among each other and the first mesh ground plane to form a stack structure on the substrate, a second IMD layer being on the stack structure, and a signal transmission line being on the second IMD layer. Wherein, each first IMD layer has a plurality of vias to correspondingly connect the first and the m second mesh ground planes, therein, m≧2 and m is a natural number, and the m second mesh ground planes under the signal transmission line have at least one slit structure.

25 Claims, 10 Drawing Sheets

COMPLEMENTARY-CONDUCTING-STRIP TRANSMISSION LINE STRUCTURE WITH PLURAL STACKED MESH GROUND PLANES

BACKGROUND OF THE INVENTION

1. Field of the Invention

This invention generally relates to the field of transmission line structure, and more particularly, to a complementary-conducting-strip transmission line (thereinafter called CCS TL) structure whose capacitive region has at least one slit structure.

2. Description of the Prior Art

Recently, a literature survey shows that there has been renewed interest in the implementation of the microwave/millimeter transmission line based hybrids, which are fabricated by laminated PCB, in monolithic integrated technologies (T. Hirota, A. Minakawa, and M. Muraguchi, "Reduced-size branch-line and rat-race hybrids for uniplanar MMICs," *IEEE Trans. Microwave Theory and Tech.*, vol. 38, no. 3, pp. 270-275, March 1990; I. Toyoda, T. Hirota, T. Hiraoka, and T. Tokumitsu, "Multilayer MMIC branch-line coupler and broad-side coupler," *IEEE* 1992 *Microwave and millimeter-wave monolithic circuit symp.*, pp. 79-82, 1992; K. Hettak, G. A. Morin, and M. G. Stubbs, "Compact MMIC CPW and asymmetric CPS branch-Line couplers and Wilkinson dividers using shunt and series stub loading," *IEEE Trans. Microwave Theory and Tech.*, vol. 53, no. 5, pp. 1624-1635, May 2005; Y. Yun, "A novel microstrip-line structure employing a periodically perforated ground metal and its application to highly miniaturized and low-impedance passive components fabricated on GaAs MMIC," *IEEE Trans. Microwave Theory and Tech.*, vol. 53, no. 6, pp. 1951-1959, June 2005; K. Hettak, G. A. Morin, and M. G. Stubbs, "A new miniaturized type of three-dimensional SiGe 90° hybrid coupler at 20 GHz using the meandering TFMS and stripline shunt stub loading," *IEEE MTT-S Int. Microwave symp. Dig.*, pp. 33-36, 2007). As a result, the technologies mentioned above can easily meet the needs for size integration by applying the multilayer technology to miniaturize hybrids.

On the other hand, very little work has been reported in the course of implementing the miniaturized hybrids in standard CMOS process due to the availability of manufactured passive components with low quality-factor. The concepts of the synthetic quasi-transverse-electromagnetic (quasi-TEM) transmission line (or complementary-conducting-strip transmission line (thereinafter called CCS TL)) were recently reported, achieving low-loss and circuit miniaturization simultaneously (M. -J. Chiang, H. -S. Wu and C. -K. C. Tzuang, "Design of synthetic quasi-TEM transmission line for CMOS compact integrated circuit," *IEEE Trans. Microwave Theory and Tech.*, vol. 55, no. 12, part 1, pp. 2512-2520, December 2007; M. -J. Chiang, H. -S. Wu and C. -K. C. Tzuang, "A Kα-band CMOS Wilkinson power divider using synthetic quasi-TEM transmission lines," *IEEE Microw. Wireless Compon. Lett.*, vol. 17, no. 12, pp. 837-839, December 2007; S. Wang, H. -S. Wu, and C. -K. C. Tzuang, "Compacted Kα-band CMOS rat-race hybrid using synthesized transmission line," *IEEE MTT-S Int. Microwave symp. Dig.*, pp. 1023-1026, 2007). Such successes are mainly caused by efficiently meandered transmission line to achieve highest degree of integration. Furthermore, the metal density, which denote the ratio of the total metal layout area to the occupied area, is strongly required by the foundry to manage the variation of CMP in wafer manufacture, maintaining the wafer yield and design reliability (A. B. Kahng, G. Robins, A. Singh, and Zelikovsky, "New and exact filling algorithms for layout density control," *Proceedings of the* 12$^{th}$ *International Conference on VLSI Design* (*VLSID*'99), pp. 106-110, January 1999). The foundry requires very metal layer in CMOS process to meet the minimum metal density requirement in order to maintain the wafer yield in wafer manufacture. Such process issue, which is specifically defined by the manufacture, dominated the yield of the CMOS circuit. Very recently, two on-chip transmission lines had been reported to demonstrate their realizations can be fully compatible with the standard CMOS processes and can be designed for meeting the requirements of metal density. The CMOS transmission line shows that the multilayer coplanar waveguide (thereinafter called MCPW) with the split ground plane is realized by only the two-topmost metal layers (Y. Zhu, S. Wang and H. Wu, "Multilayer coplanar waveguide transmission lines compatible with standard digital silicon technologies," IEEE MTT-S Int. Microwave symp. Dig., 2007, pp. 1567-1570). The guiding characteristics of the MCPW can be synthesized by the width of the signal trace and the gap between two half ground planes. As shown in FIG. 3 of Y. Zhu, S. Wang and H. Wu, "Multilayer coplanar waveguide transmission lines compatible with standard digital silicon technologies, " IEEE MTT-S Int. Microwave symp. Dig. 2007, pp. 1567-1570., the split ground plane shields the signal trace from the extra dummy metal filling, which is not included in the MCPW syntheses. The other CMOS transmission line is so-called the CCS TL (M. -J. Chiang, H. -S. Wu and C. -K. C. Tzuang, "Design of synthetic quasi-TEM transmission line for CMOS compact integrated circuit," *IEEE Trans. Microwave Theory and Tech.*, vol. 55, no. 12, part 1, pp. 2512-2520, December 2007). The CCS TL had been demonstrated on the CMOS components and SOC (system on chip) miniaturization. As to other monolithic integrated circuits, they need additional chip area for filling dummy metal to keep the yield of the CMOS circuit and design reliability when their metal density does not meet the manufacturing requirement. However, by following the abovementioned process, the monolithic integrated circuits cannot achieve the miniaturization.

In view of the drawbacks mentioned with the prior art of transmission line structure, there is a continuous need to develop a new and improved CCS TL structure that overcomes the shortages associated with the prior art. The advantages of the present invention are that it solves the problems mentioned above.

SUMMARY OF THE INVENTION

In accordance with the present invention, a CCS TL structure substantially obviates one or more of the problems resulted from the limitations and disadvantages of the prior art mentioned in the background.

One of the purposes of the present invention is to provide a CCS TL structure, which meets manufacturing requirement of metal density, to decrease the requirement of additional chip area and the use of dummy metal, and to improve the wafer yield and circuit design reliability. If any metal layer on circuit design in CMOS process does not meet the minimum metal density requirement, its design rule check (DRC) will be failed. It needs some extra areas for filling some metals to increase the metal density to meet the minimum metal density requirement, and such filling metal is so-called "dummy metal". Furthermore, the prototype of the CCS TL structure can enhance the characteristic impedance ($Z_c$) and quality factor (Q-factor), while the impact on the slow-wave factor (SWF) is only minimum.

One of the purposes of the present invention is to form at least one slit at the capacitive region of a CCS TL structure and to adjust the width of the CCS TL by varying the size (or area) of the slit, whereby the layout area of the signal transmission line increases to make the metal density increase.

The present invention provides a CCS TL structure. The CCS TL structure includes a substrate, at least one first mesh ground plane, m second mesh ground planes having m first inter-media-dielectric (thereinafter called IMD) layers interlaced with and stacked among each other and the at least one first mesh ground plane to form a stack structure on the substrate, a second IMD layer being on the stack structure, and a signal transmission line being on the second IMD layer. Wherein, each of the m first IMD layers has a plurality of vias to correspondingly connect the at least one first and the m second mesh ground planes, therein, m≧2 and m is a natural number, and the m second mesh ground planes under the signal transmission line have at least one slit structure.

The present invention also offers a CCS TL structure. The CCS TL structure includes a substrate, a first mesh ground plane, a second mesh ground plane having a first IMD layer between the first mesh ground plane to form a stack structure on the substrate, a second IMD layer being on the stack structure, and a signal transmission line being on the second IMD layer. Wherein, the first IMD layer has a plurality of vias to connect the first and the second mesh ground planes, and the second mesh ground plane under the signal transmission line has at least one slit structure.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Some embodiments of the present invention will now be described in greater detail. Nevertheless, it should be noted that the present invention can be practiced in a wide range of other embodiments besides those explicitly described, and the scope of the present invention is expressly not limited except as specified in the accompanying claims.

Moreover, some irrelevant details are not drawn in order to make the illustrations concise and to provide a clear description for easily understanding the present invention.

Figure 1:
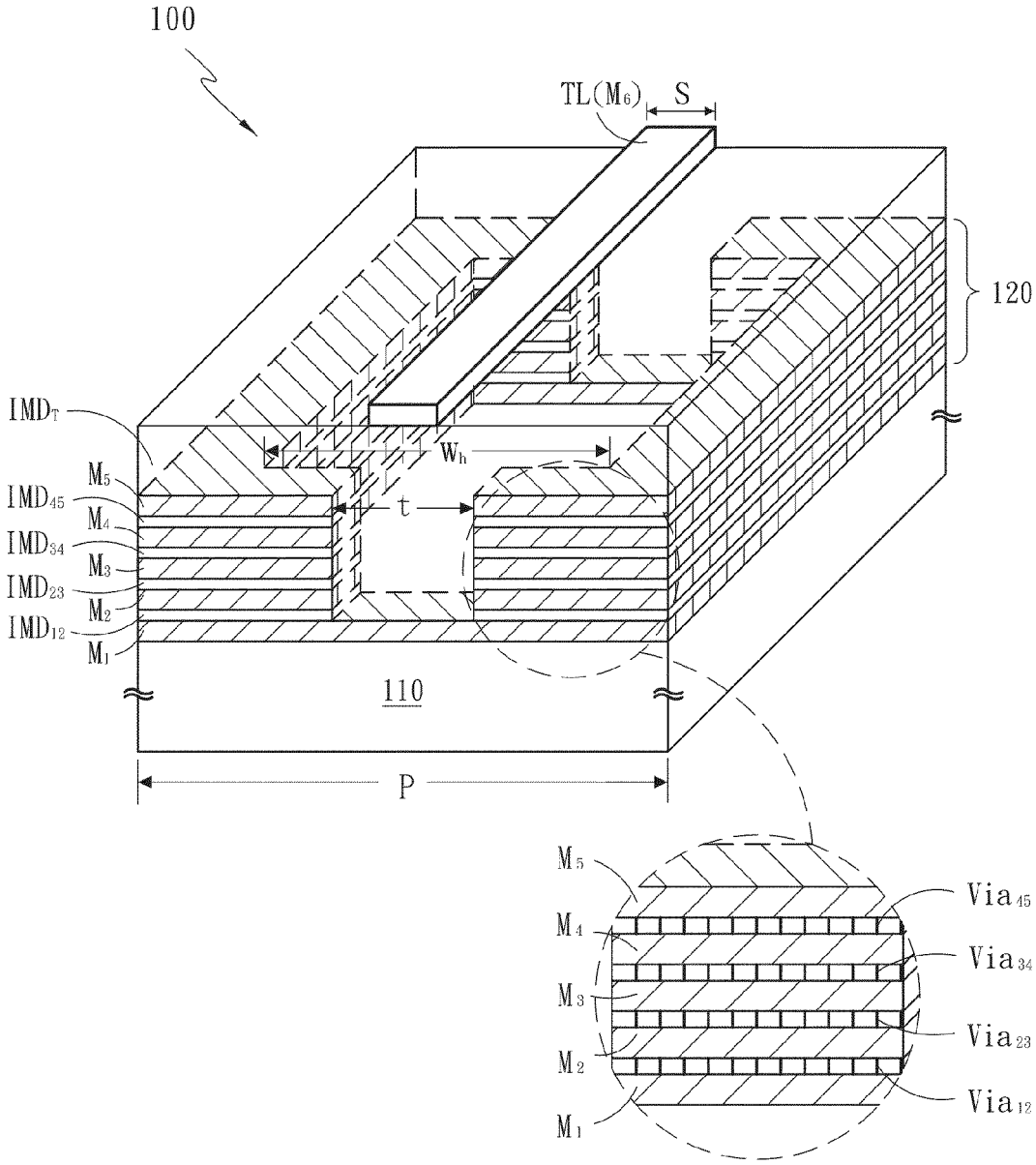
FIG. 1 illustrates the three-dimensional perspective structure of one preferred embodiment in accordance with the present invention.

Referring to FIG. 1, the three-dimensional perspective structure of one preferred embodiment 100 in accordance with the present invention is illustrated. A substrate 110 has a size P (also called a periodicity P). At least one first mesh ground plane $M_1$ and m second mesh ground planes $M_2$, $M_3$, $M_4$, and $M_5$ interlace with m first inter-media-dielectric (thereinafter called IMD) layers $IMD_{12}$, $IMD_{23}$, $IMD_{34}$, and $IMD_{45}$ (wherein m≧2 and m is a natural number; in the present embodiment, m=4), that is, the first IMD layer $IMD_{12}$ is between the first mesh ground plane $M_1$ and the second mesh ground plane $M_2$, the first IMD layer $IMD_{23}$ is between the second mesh ground planes $M_2$ and $M_3$, the first IMD layer $IMD_{34}$ is between the second mesh ground planes $M_3$ and $M_4$, and the first IMD layer $IMD_{45}$ is between the second mesh ground planes $M_4$ and $M_5$, to form a stack structure 120 on the substrate 110. Wherein, the first IMD layers $IMD_{12}$, $IMD_{23}$, $IMD_{34}$, and $IMD_{45}$ respectively have a plurality of vias $via_{12}$, $via_{23}$, $via_{34}$, and $via_{45}$ to connect the first mesh ground plane $M_1$ and the second mesh ground planes $M_2$, $M_3$, $M_4$, and $M_5$, correspondingly. For example, the first IMD layer $IMD_{12}$ has a plurality of vias $via_{12}$ to connect the first and the second mesh ground planes $M_1$ and $M_2$, the first IMD layer $IMD_{23}$ has a plurality of vias $via_{23}$ to connect the second mesh ground planes $M_2$ and $M_3$, the first IMD layer $IMD_{34}$ has a plurality of vias $via_{34}$ to connect the second mesh ground planes $M_3$ and $M_4$, and the first IMD layer $IMD_{45}$ has a plurality of vias $via_{45}$ to connect the second mesh ground planes $M_4$ and $M_5$, by doing so, the thickness of the mesh ground planes is able to be increased. In the present invention, each mesh ground plane, such as $M_1$, $M_2$, $M_3$, $M_4$, and $M_5$, is a metal layer with an inner slot, and the size of the inner slot (or called mesh slot) is defined by $W_h$.

A second IMD layer $IMD_T$ is on the stack structure 120. A signal transmission line TL with a width S is on the second IMD layer $IMD_T$. Herein, the second mesh ground planes $M_2$, $M_3$, $M_4$, and $M_5$ under the signal transmission line TL individually have at least one slit to form a slit structure with the size t. In the present embodiment, the signal transmission line TL is a straight line across above the first mesh ground plane $M_1$ and the second mesh ground planes $M_2$, $M_3$, $M_4$, and $M_5$, thus the second mesh ground planes $M_2$, $M_3$, $M_4$, and $M_5$ under the signal transmission line TL individually have two slit structures. The area of each slit structure is defined as $((P-W_h)/2)*t$, where P is the size (periodicity) of the substrate 110, $W_h$ is the size of the mesh slot of the m second mesh ground planes, and t is the slit size of the slit structure. Accordingly, the characteristic impedance and the width of the signal transmission line TL can be changed to adjust the layout area of the signal transmission line on the metal layer M6 in order to adjust the metal density by varying the slit size of the slit structure (or the area of the slit structure) at the inner slot (or called capacitive region) of the second mesh ground planes $M_2$, $M_3$, $M_4$, and $M_5$.

The inventor, here, would like to emphasize that the geometric shape for the substrate 110, the first mesh ground plane $M_1$, the second mesh ground planes $M_2$, $M_3$, $M_4$, and $M_5$, the first IMD layers $IMD_{12}$, $IMD_{23}$, $IMD_{34}$, and $IMD_{45}$, and the second IMD layer $IMD_T$ can be varied in shapes, and should not be limited to the square shape shown in the present embodiment. Moreover, in the present embodiment, the first mesh ground plane $M_1$ only shows one layer at the bottom of the stack structure 120 (on the substrate 110) for simple explanation, however, the first mesh ground plane $M_1$ could be a multilayer structure in practice and also could be at the top of the stack structure or in the stack structure. Also, in the present embodiment, the second IMD layer $IMD_T$ just shows one layer for simple explanation, however, the second IMD layer $IMD_T$ could be a multilayer IMD structure in practice. Furthermore, the inner slots of the first and the second mesh ground planes are also filled with IMD material, and this part will not be repeated thereinafter.

Figure 2A:
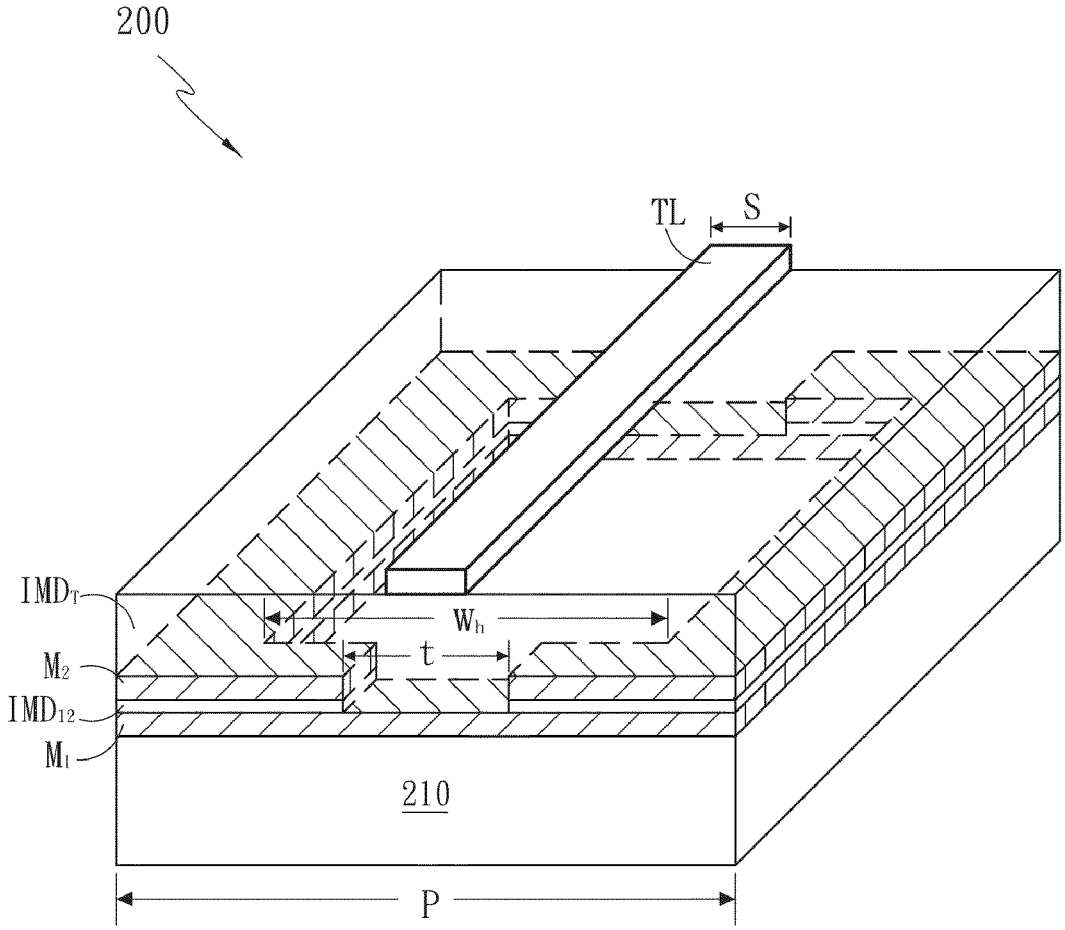
FIG. 2A depicts the three-dimensional perspective structure of another preferred embodiment in accordance with the present invention.

Referring to FIG. 2A, the three-dimensional perspective structure of another preferred embodiment 200 in accordance with the present invention is illustrated. A substrate 210 has a size P (also called a periodicity P). A first mesh ground plane $M_1$ and a second mesh ground plane $M_2$ sandwich a first IMD layer $IMD_{12}$ to form a stack structure on the substrate 210. Wherein, the first IMD layer $IMD_{12}$ has a plurality of vias to connect the first mesh ground plane $M_1$ and the second mesh ground plane $M_2$ to increase the thickness of the mesh ground planes. In the present invention, each mesh ground plane, such as $M_1$ and $M_2$, is a metal layer with an inner slot, and the size of the inner slot (or called mesh slot) is defined as $W_h$. A second IMD layer $IMD_T$ is on the stack structure. A signal transmission line TL with a width S is on the second IMD layer $IMD_T$. Herein, the second mesh ground plane $M_2$ under the signal transmission line TL has at least one slit to form a slit structure with the slit size t. In the present embodiment, the signal transmission line TL is a straight line across above the first mesh ground plane $M_1$ and the second mesh ground plane $M_2$, then the second mesh ground plane $M_2$ under the signal transmission line TL has two slit structures. The area for each slit structure is defined as $((P-W_h)/2)*t$, where P is the size (periodicity) of the substrate 210, $W_h$ is the size of the mesh slot of the second mesh ground plane, and t is the slit size of the slit structure.

Figure 2B:
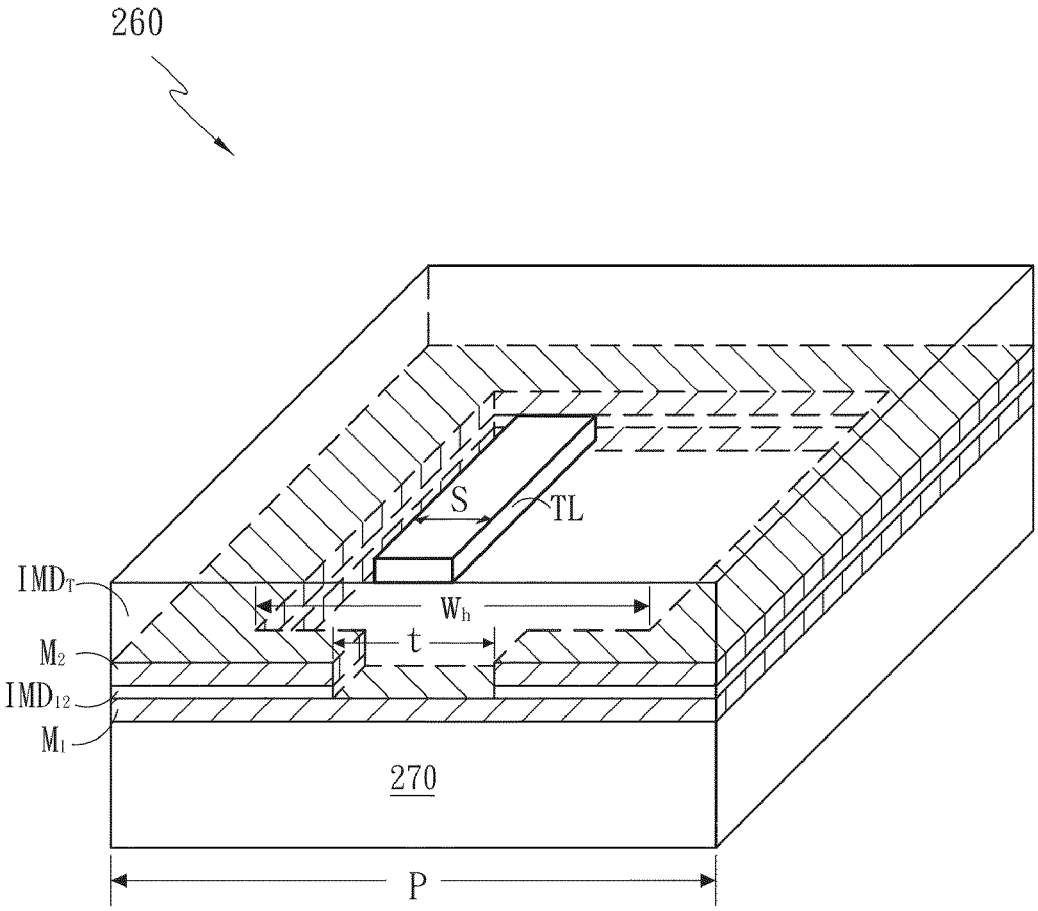
FIG. 2B depicts the three-dimensional perspective structure of further another preferred embodiment in accordance with the present invention.

Referring to FIG. 2B, the three-dimensional perspective structure of further another preferred embodiment 260 in accordance with the present invention is illustrated. The difference between FIG. 2B and FIG. 2A is that the signal transmission line TL just crosses above one side of the first mesh ground plane $M_1$ and the second ground plane $M_2$. As a result, in FIG. 2B, the second mesh plane $M_2$ under the signal transmission line TL has only one slit to form a slit structure with the slit size t, and this structure can be applied to all embodiments of the present invention. As for the substrate 270 and other elements, such as P, $IMD_{12}$, $IMD_T$, $W_h$, S, shown in FIG. 2B, they are the same as the substrate 210 and those elements having the same denotation in FIG. 2A, thus they will not be described again here.

Figure 3A:
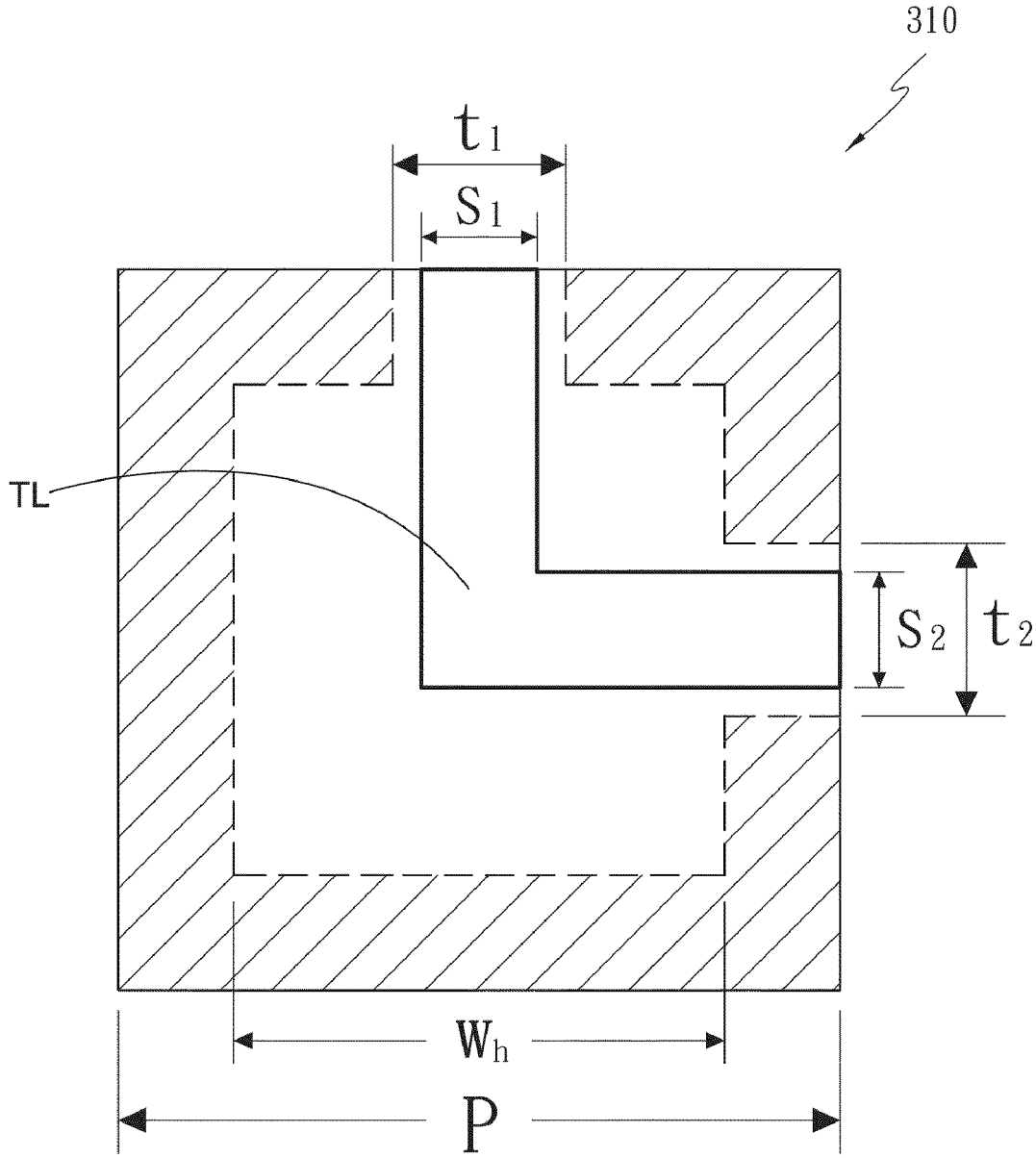
FIG. 3A shows the top view of one preferred embodiment in accordance with the present invention.
Figure 3B:
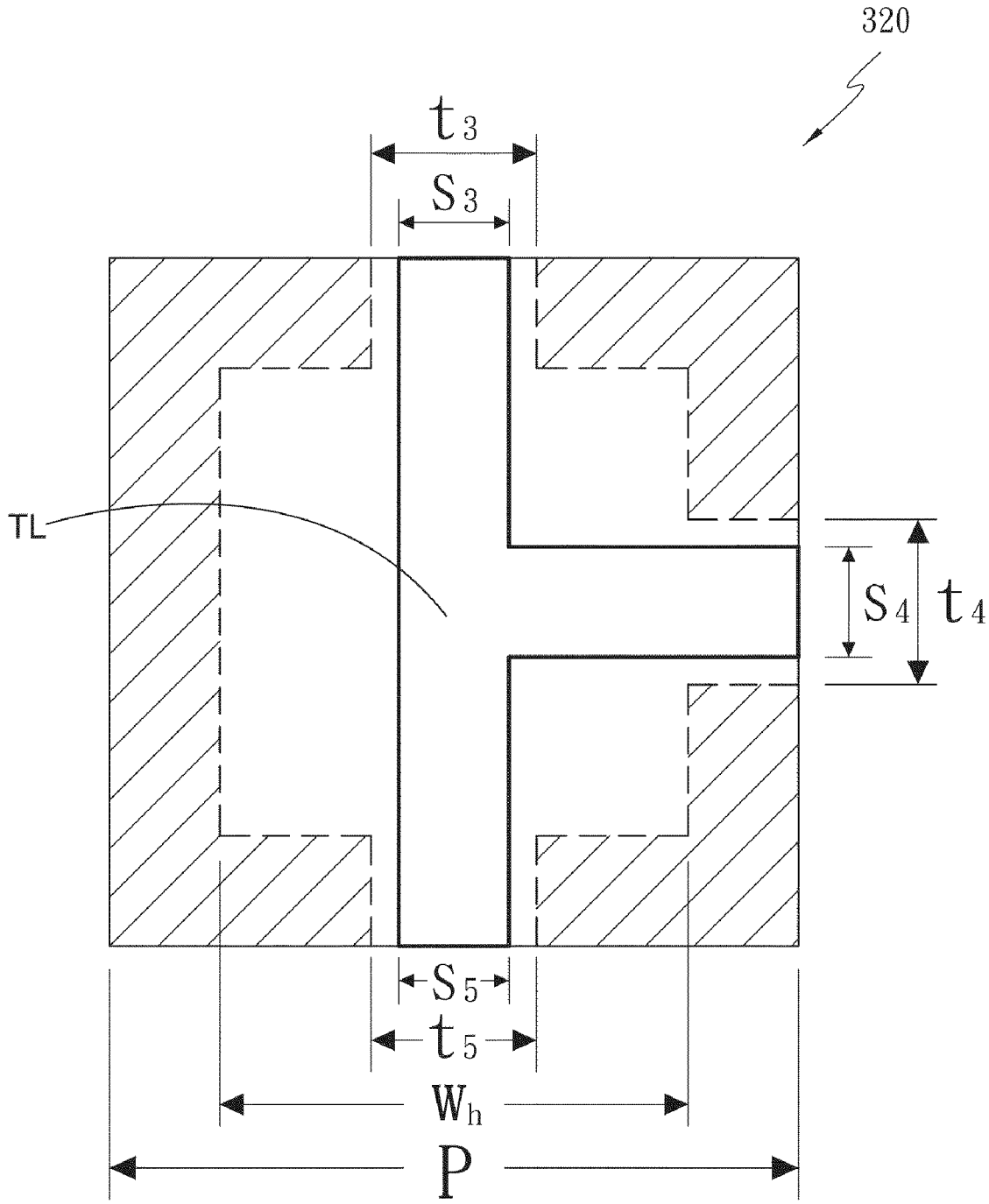
FIG. 3B shows the top view of another preferred embodiment in accordance with the present invention.
Figure 3C:
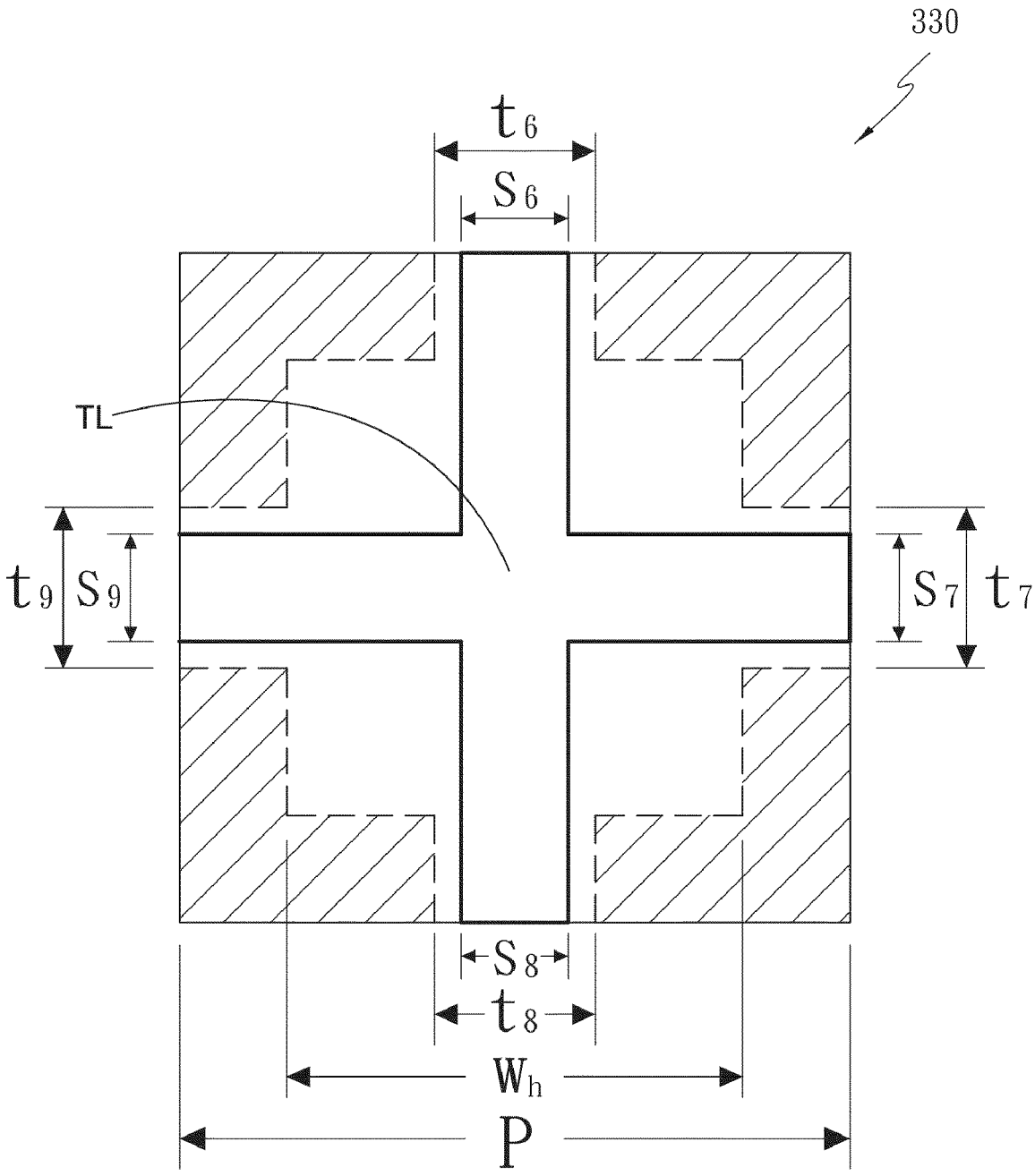
FIG. 3C shows the top view of further another preferred embodiment in accordance with the present invention.

Referring to FIGS. 3A, 3B, and 3C, the top views for three preferred embodiments 310, 320, and 330 in accordance with the present invention are respectively depicted. In FIG. 3A, a signal transmission line TL is an L-line form and the widths thereof are $S_1$ and $S_2$ at the two ends, respectively. Two slit structures with the slit sizes $t_1$ and $t_2$ are under the signal transmission line TL with the line widths $S_1$ and $S_2$, correspondingly. However, in the present embodiment, the widths of the transmission line could be the same, that is, $S_1=S_2$, or could be different, that is, $S_1 \neq S_2$. In FIG. 3B, a signal transmission line TL is a T-line form and the widths thereof are $S_3$, $S_4$, and $S_5$ (in other embodiments, the widths of the transmission line could be $S_3=S_4=S_5$, $S_3 \neq S_4 \neq S_5$, $S_3=S_4 \neq S_5$, $S_3 \neq S_4=S_5$, or $S_3=S_5 \neq S_4$) Three slit structures with the slit sizes $t_3$, $t_4$, and is are under the signal transmission line TL with the line widths $S_3$, $S_4$, and $S_5$, respectively. In FIG. 3C, a signal transmission line TL is a crossing-line form and the widths thereof are $S_6$, $S_7$, $S_8$, and $S_9$ (the widths of the transmission line could be the same, different, or varying changes). Four slit structures with the slit sizes $t_6$, $t_7$, $t_8$, and $t_9$ are under the signal transmission line TL with the line widths $S_6$, $S_7$, $S_8$, and $S_9$, respectively. As for the periodicity P and mesh slot size $W_h$ shown in FIGS. 3A, 3B and 3C, they are the same as those described above thus it will not be repeated here. However, the inventor would like to stress that the present invention adjusts the characteristic impedance and the width of the signal transmission line by varying the slit size, hence the slit size can be changed depending on the needs in practices. That is, it is not necessary to make the width of the transmission line bigger than the slit size as shown in FIGS. 3A, 3B, and 3C. Besides, the slit structures in the present invention can be deviated to left or to right in order to cooperate with the layout of the transmission line, and they should not be limited to the position of ½ periodicity P. That is, the slit structures are not always at the middle of the periodicity P. Moreover, the signal transmission line can get thicker by connecting two signal transmission lines on two adjacent metal layers together through a plurality of vias to increase the thickness thereof.

Figure 4:
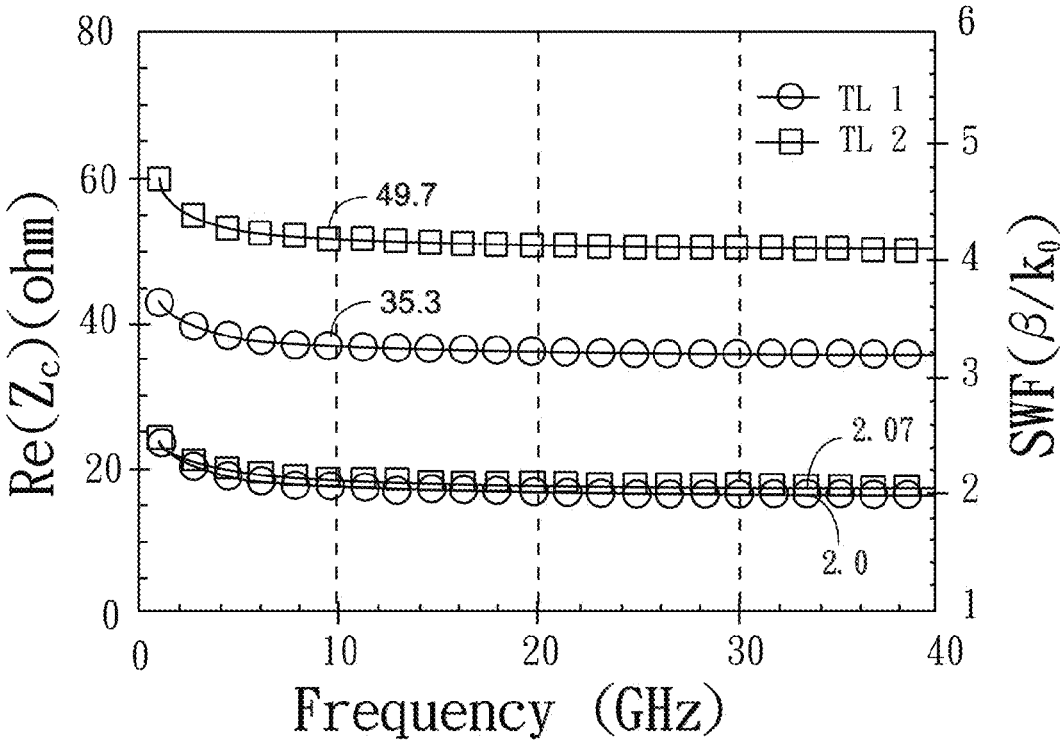
FIG. 4 shows the relation curves among the complex characteristic impedance ($Z_c$), slow-wave factor (SWF), and frequency which are extracted from one preferred embodiment in accordance with the present invention.

Referring to FIG. 4, the relation curves among the complex characteristic impedance ($Z_c$) in Ohm, slow-wave factor (SWF) in β/ko, and frequency in GHz which are extracted from one preferred embodiment shown in FIG. 1 in accordance with the present invention are shown. The inventor would like to emphasize that the related data set for simulations and the results obtained from simulations are used to explain the simulation processes and the results of preferred embodiments in accordance with the present invention, but not limit the implementing of the present invention. The data set for simulations is defined as below. The periodicity (P) is defined as 30.0 μm. The thickness of mesh ground planes ($M_1$~$M_5$) is 6.35 μm. The mesh slot size ($W_h$) is 21.0 μm. The slit sizes (t) are respectively 14.0 μm and 9.0 μm, and the thickness thereof is 5.8 μm. The widths (S) of the transmission line are respectively 13.0 μm and 7.0 μm, and the thickness thereof is 2.0 μm. The relative dielectric constants of the IMD and the substrate are 4.0 and 11.9, respectively, and the thickness of the IMD is 0.9 μm. The thickness and conductivity of the substrate are 482.6 μm and 11.0 S/m, respectively. Moreover, the simulations are performed by the commercial software package Ansoft HFSS, and the results obtained from the simulations are shown in FIG. 4.

In FIG. 4, the curves TL 1 show the extracted results from the simulations as the slit size (t) being 14.0 μm and the width (S) of the signal transmission line being 13.0 μm, and the curves TL 2 show the extracted results in case of the slit size (t) being 9.0 μm and the width (S) of the signal transmission line being 7.0 μm. The real parts of $Z_c$ {i.e. $Re(Z_c)$} of the TL 1 and TL 2 at Ka-band (26~40 GHz) are 35.3Ω and 49.7Ω, respectively. The imaginary parts of $Z_c$ (not shown) are nearly identical. The SWF of the TL 1 and TL 2 at Ka-band are 2.0 and 2.07, respectively. Accordingly, the mesh ground plane with a slit makes an increase of the characteristic impedance $Z_c$ of the signal transmission line. Hence, for keeping the same $Z_c$ design, the design with a slit can be used a wider line-width of top metal (such as $M_6$ in 1P6M CMOS technology) than that of the design without silt to increase the percentage of metal density of top metal.

Figure 5:
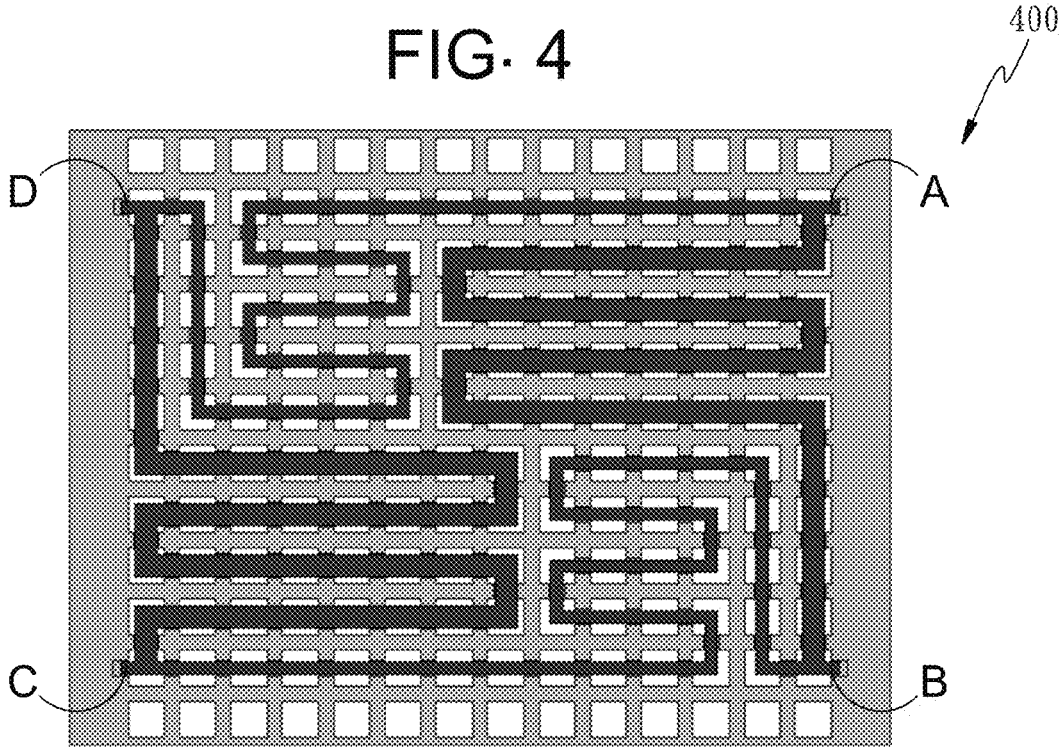
FIG. 5 depicts the layout of one preferred application circuit integrated by several preferred embodiments in accordance with the present invention.

Referring to FIG. 5, the layout for one preferred application circuit 400 integrated by several preferred embodiments in accordance with the present invention is depicted. The application circuit 400 shows a branch-line coupler, and ends denoted A, B, C, and D are input/output ends thereof. In FIG. 5, the widths of the signal transmission lines are different and are adjusted depending on the sizes of the slit structures under the signal transmission lines. Accordingly, the wider signal transmission lines increase the metal density of the top metal layer to solve the drawbacks of low metal density caused by hybrid circuit design and of additional chip area for dummy metal inserts. Further, the yield for integrated circuit and the reliability for circuit design also can be improved.

Figure 6A:
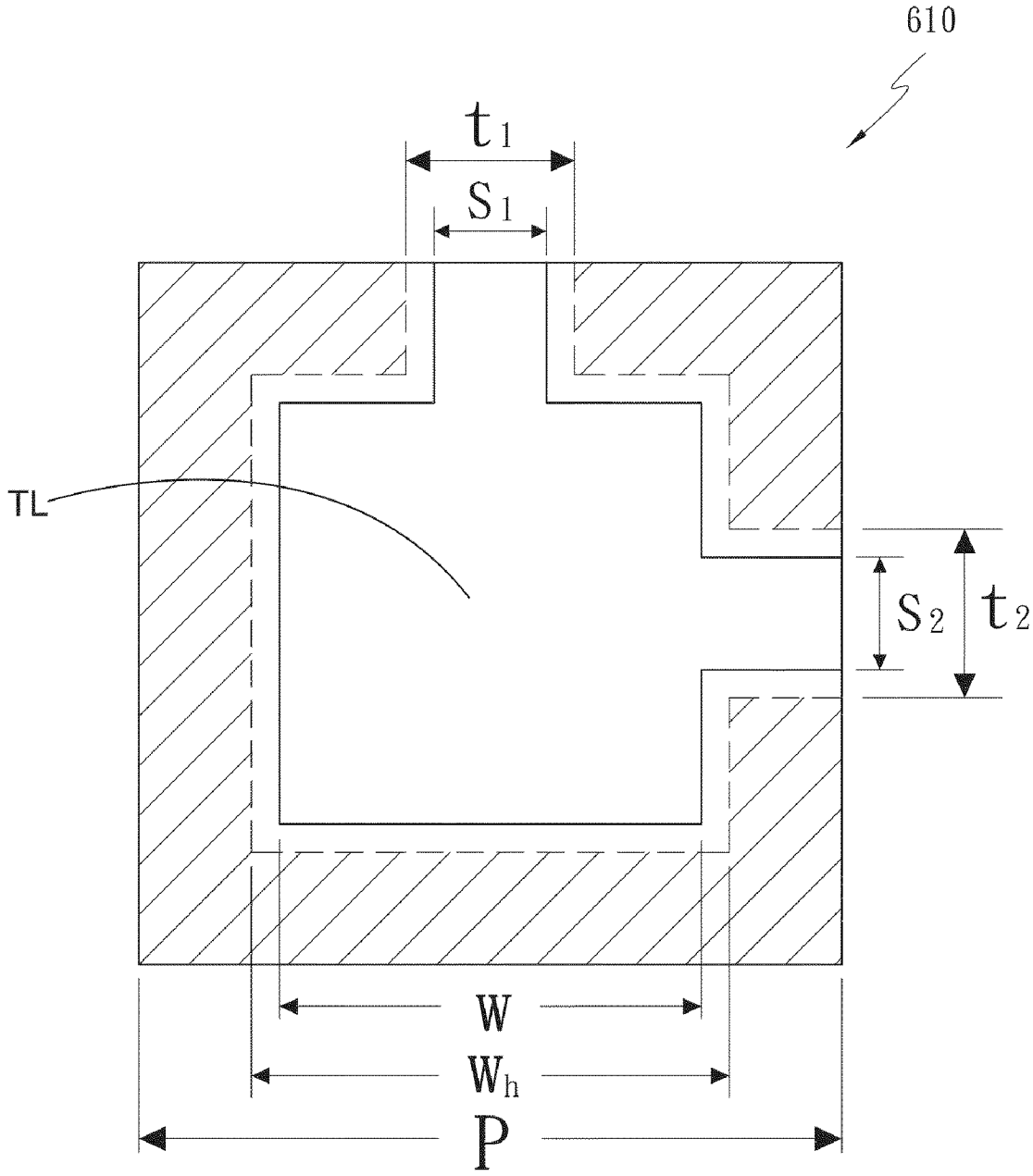
FIGS. 6A-6C show the top views of still other three preferred embodiments in accordance with the present invention.
Figure 6B:
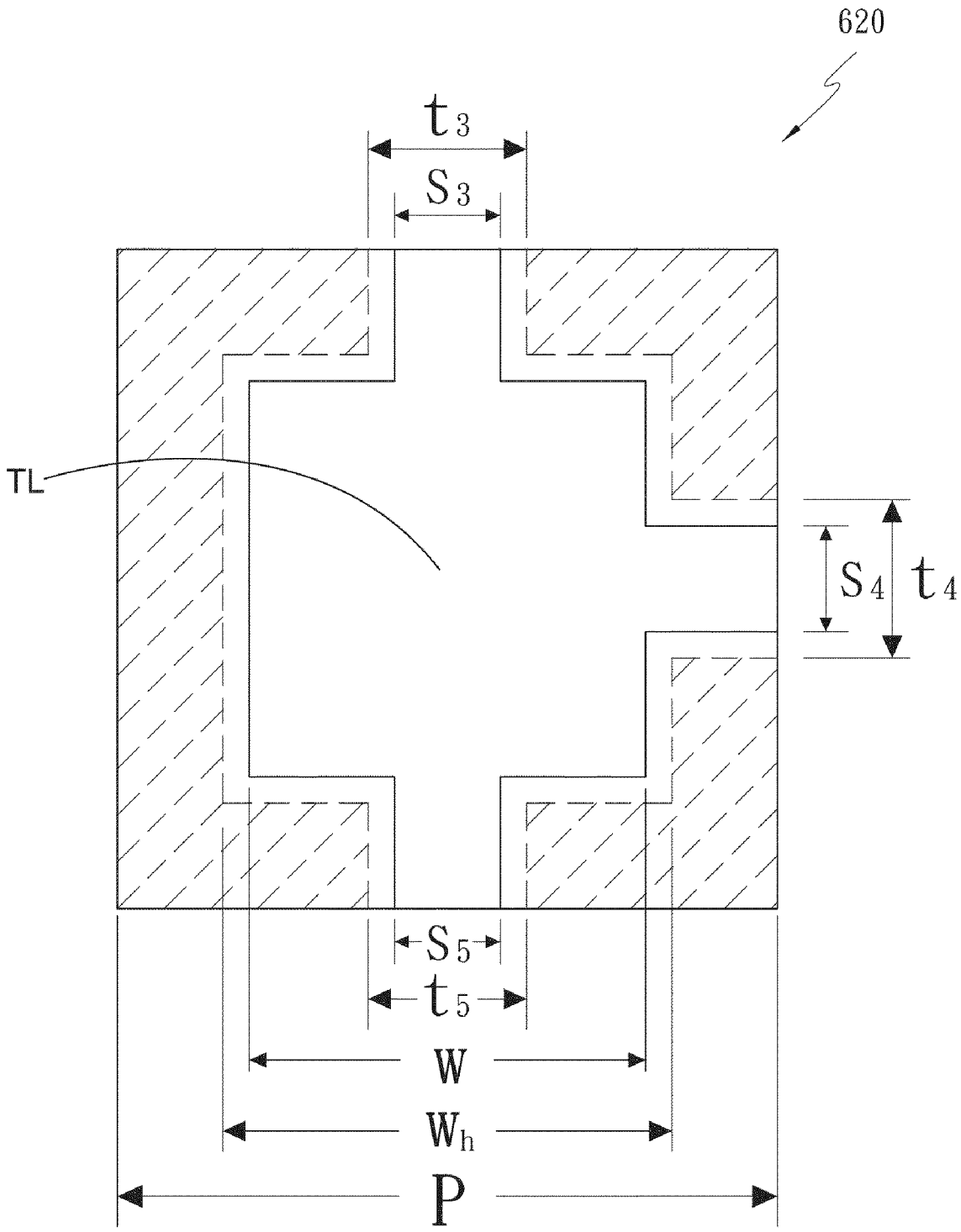
Figure 6C:
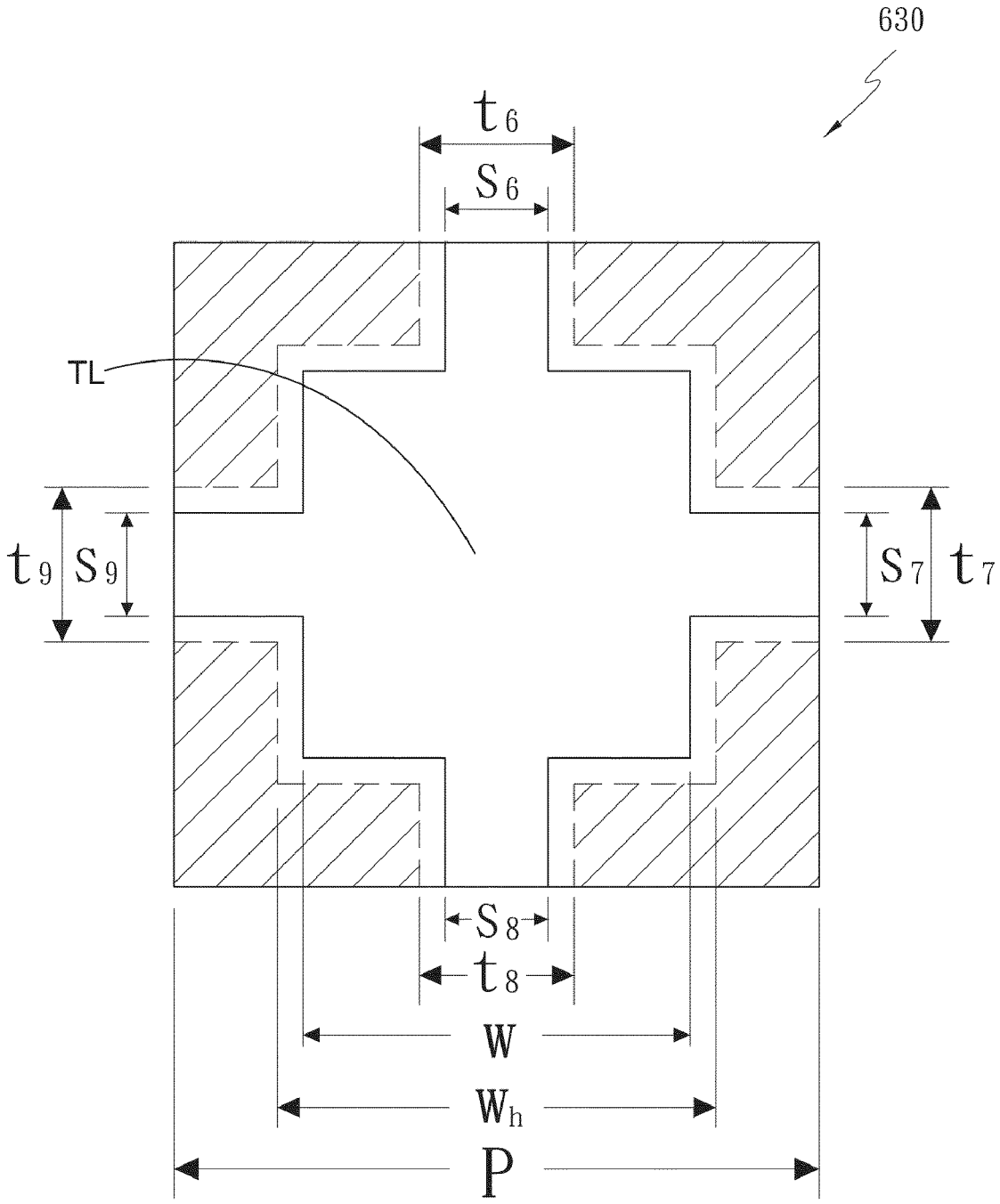

Referring to FIGS. 6A, 6B, and 6C, the top views for still other three preferred embodiments 610, 620, and 630 in accordance with the present invention are depicted, respectively. The difference among FIGS. 3A, 3B, and 3C and FIGS. 6A, 6B, and 6C is that the transmission lines TL above the mesh slots in FIGS. 6A, 6B, and 6C are respectively expanded to be patches. For examples, the transmission line TL above the mesh slot has a width W that is bigger than its original widths $S_1$ and $S_2$ in FIG. 6A; the transmission line TL above the mesh slot has a width W that is bigger than its original widths $S_3$, $S_4$ and $S_5$ in FIG. 6B; and the transmission line TL above the mesh slot has a width W that is bigger than its original widths $S_6$, $S_7$, $S_8$ and $S_9$ in FIG. 6C. Herein, the size (W) of the patch can be smaller than the size (P) of the unit cell. As for the denotations in FIGS. 6A, 6B, and 6C, such as the slot size $W_h$, the slit sizes $t_1$ and $t_2$ shown in FIG. 6A, the slit sizes $t_3$, $t_4$, $t_5$, and $t_6$ shown in FIG. 6B, and the slit sizes $t_7$, $t_8$, and $t_9$ shown in FIG. 6C, they are the same as those described above thus they will not be repeated here.

Although specific embodiments have been illustrated and described, it will be obvious to those skilled in the art that various modifications may be made without departing from what is intended to be limited solely by the appended claims.

What is claimed is:

1. A complementary-conducting-strip transmission line structure, comprising:

a substrate;

at least one first mesh ground plane;

m second mesh ground planes, having m first inter-media-dielectric layers interlaced with and stacked among each other and said at least one first mesh ground plane to form a stack structure on said substrate, wherein each of said m first inter-media-dielectric layers has a plurality of vias to correspondingly connect said at least one first and said m second mesh ground planes, where m is a natural number and $m \geqq 2$;

a second inter-media-dielectric layer, being on said stack structure; and a signal transmission line, being on said second inter-media-dielectric layer, wherein, said m second mesh ground planes under said signal transmission line have at least one slit structure, an area of said at least one slit structure is $((P-W_h)/2)*t$, where P is a size of said substrate, $W_h$ is a size of a mesh slot of said m second mesh ground planes, and t is a size of said at least one slit structure.

2. The complementary-conducting-strip transmission line structure according to claim 1, wherein said at least one first mesh ground plane is in said stack structure.

3. The complementary-conducting-strip transmission line structure according to claim 1, wherein said signal transmission line comprises straight-line form.

4. The complementary-conducting-strip transmission line structure according to claim 3, wherein said at least one slit structure comprises two slit structures.

5. The complementary-conducting-strip transmission line structure according to claim 1, wherein said signal transmission line comprise L-line form.

6. The complementary-conducting-strip transmission line structure according to claim 5, wherein said at least one slit structure comprises two slit structures.

7. The complementary-conducting-strip transmission line structure according to claim 1, wherein said signal transmission line comprise T-line form.

8. The complementary-conducting-strip transmission line structure according to claim 7, wherein said at least one slit structure comprises three slit structures.

9. The complementary-conducting-strip transmission line structure according to claim 1, wherein said signal transmission line comprise crossing-line form.

10. The complementary-conducting-strip transmission line structure according to claim 9, wherein said at least one slit structure comprises four slit structures.

11. The complementary-conducting-strip transmission line structure according to claim 1, wherein said signal transmission line above the mesh slot of said m second mesh ground planes is expanded to be a patch.

12. The complementary-conducting-strip transmission line structure according to claim 1, wherein said at least one first mesh ground plane is at the bottom of said stack structure.

13. The complementary-conducting-strip transmission line structure according to claim 1, wherein said at least one first mesh ground plane is at the top of said stack structure.

14. A complementary-conducting-strip transmission line structure, comprising:

a substrate;

a first mesh ground plane;

a second mesh ground plane, having a first inter-media-dielectric layer between said first mesh ground plane and said second mesh ground plane to form a stack structure on said substrate, wherein said first inter-media-dielectric layer has a plurality of vias to connect said first and said second mesh ground planes;

a second inter-media-dielectric layer, being on said stack structure; and a signal transmission line, being on said second inter-media-dielectric layer, wherein, said second mesh ground plane under said signal transmission line has at least one slit structure, an area of said at least one slit structure is $((P-W_h)/2)*t$, where P is a size of said substrate, $W_h$ is a size of a mesh slot of said second mesh ground plane, and t is a size of said at least one slit structure.

15. The complementary-conducting-strip transmission line structure according to claim 14, wherein said first mesh ground plane is at the top of said stack structure.

16. The complementary-conducting-strip transmission line structure according to claim 14, wherein said first mesh ground plane is at the bottom of said stack structure.

17. The complementary-conducting-strip transmission line structure according to claim 14, wherein said signal transmission line comprises straight-line form.

18. The complementary-conducting-strip transmission line structure according to claim 17, wherein said at least one slit structure comprises two slit structures.

19. The complementary-conducting-strip transmission line structure according to claim 14, wherein said signal transmission line comprise L-line form.

20. The complementary-conducting-strip transmission line structure according to claim 19, wherein said at least one slit structure comprises two slit structures.

21. The complementary-conducting-strip transmission line structure according to claim 14, wherein said signal transmission line comprise T-line form.

22. The complementary-conducting-strip transmission line structure according to claim 21, wherein said at least one slit structure comprises three slit structures.

23. The complementary-conducting-strip transmission line structure according to claim 14, wherein said signal transmission line comprise crossing-line form.

24. The complementary-conducting-strip transmission line structure according to claim 23, wherein said at least one slit structure comprises four slit structures.

25. The complementary-conducting-strip transmission line structure according to claim 14, wherein said signal transmission line above the mesh slot of said second mesh ground plane is expanded to be a patch.

* * * * *